United States Patent [19]

Kaminkow et al.

[11] Patent Number: 5,002,279

[45] Date of Patent: Mar. 26, 1991

[54] MULTI-LEVEL PLAYING SURFACE PINBALL MACHINE APPARATUS

[75] Inventors: Joseph E. Kaminkow, Arlington Heights; Edwin Cebula, West Chicago; John L. Lund, Morton Grove, all of Ill.

[73] Assignee: Data East Pinball, Inc., Melrose Park, Ill.

[21] Appl. No.: 421,744

[22] Filed: Oct. 16, 1989

[51] Int. Cl.[5] ..... A63B 71/00

[52] U.S. Cl. ..... 273/119 A; 273/121 A

[58] Field of Search ..... 273/127 R, 127 B, 119 A, 273/121 A, 127 G, 129 R, 129 A, 129 T, 125 A, 129 V, 129 S, 119 R

[56] References Cited

U.S. PATENT DOCUMENTS

| | | | |
|---|---|---|---|
| 1,998,153 | 4/1935 | Beland | 273/127 R |
| 2,610,058 | 9/1952 | Hooker | 273/129 V |
| 3,228,688 | 1/1966 | Dennison | 273/125 A |
| 3,807,737 | 4/1974 | Breslow | 273/121 R |

*Primary Examiner*—Theatrice Brown

*Attorney, Agent, or Firm*—Gerstman & Ellis, Ltd.

[57] ABSTRACT

A pinball machine defines a play field to receive a rolling ball for pinball play. By this invention, a ball-aperture carries a first ball, a second ball rolling on the play field toward the aperture is prevented from entering the aperture and is deflected away from the aperture in a first direction by collision with the first ball in the aperture. Means are provided for displacing balls from the aperture and causing them to roll on the play field in a direction other than the first direction. Thus, by the improvement of this invention, balls directed at the aperture are sent away therefrom in two different directions, for different play patterns on the play field.

7 Claims, 2 Drawing Sheets

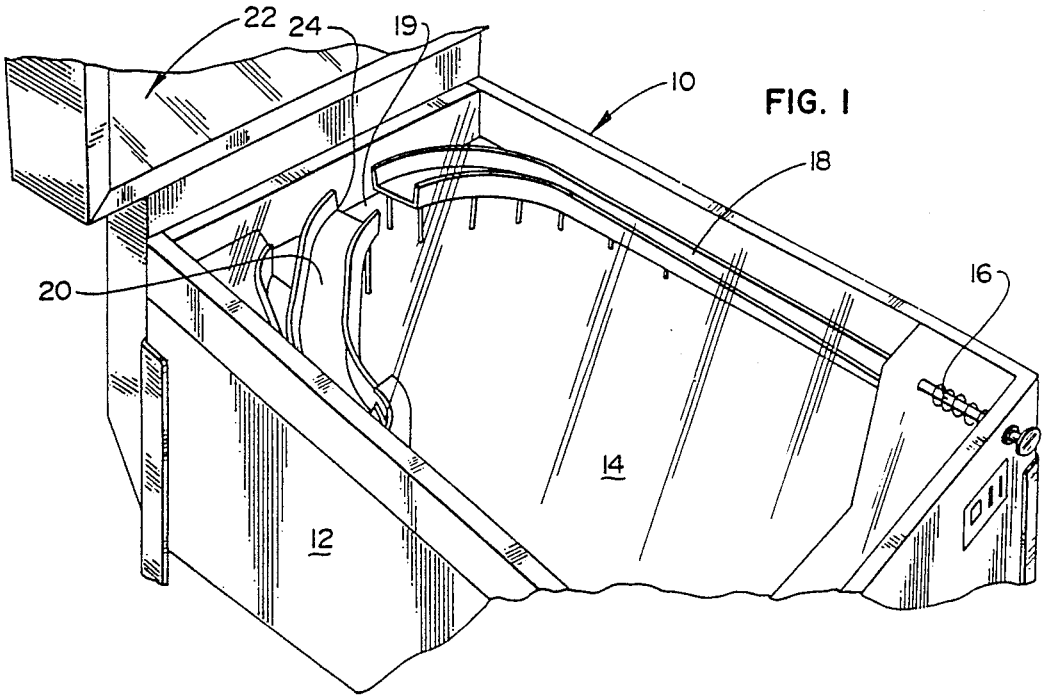
FIG. 1
FIG. 2
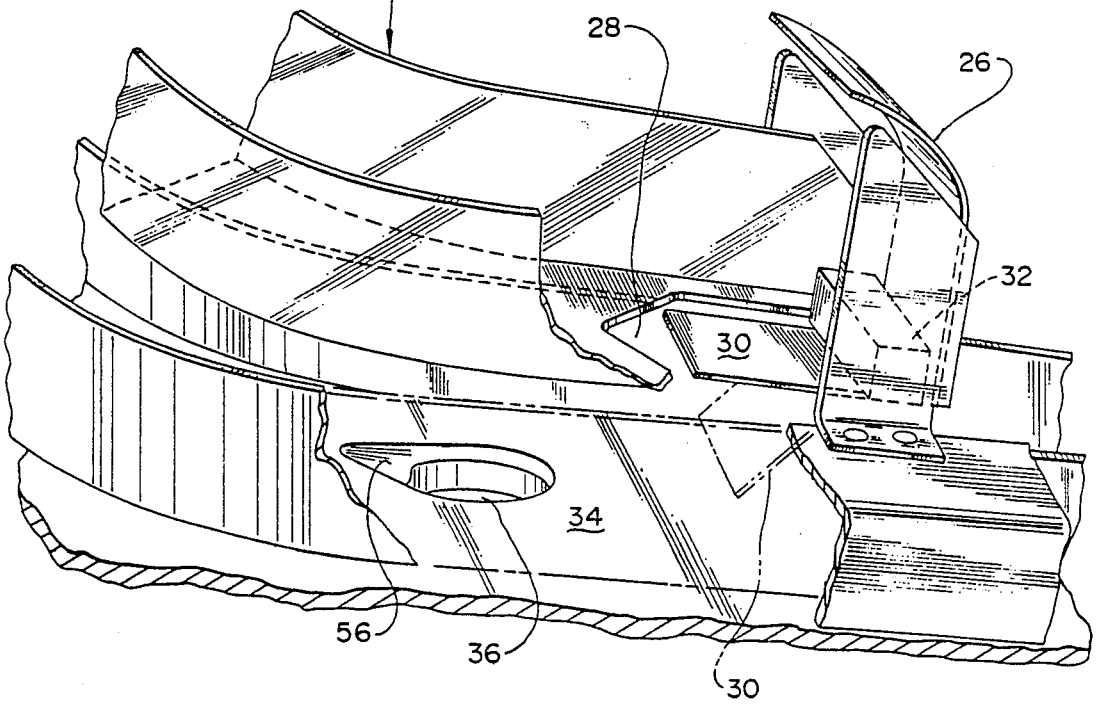

MULTI-LEVEL PLAYING SURFACE PINBALL MACHINE APPARATUS

BACKGROUND OF THE INVENTION

Pinball machines are popular play devices for places where particularly young people congregate, comprising and inclined play field, plus several targets and other play features arranged on the play field. A rolling ball is used to strike the targets, and a score is usually kept by electronic means and displayed in a prominent manner.

There is a continuing need for variable, new features, to increase the variety of the play action to hold the interest of the users.

By this invention, an increase in the variability of the play action can be provided, making use of a relatively simple structure to provide a pinball game that retains the interest of the users at a relatively low cost.

DESCRIPTION OF THE INVENTION

The pinball machine of this invention defines a play field to receive a rolling ball for pinball play. In this invention, a ball-receiving aperture is defined in the play field, the aperture being constructed so that when the aperture carries a first ball, a second ball rolling on the play field toward the aperture is prevented from entering the aperture, and is deflected away from the aperture in a first direction by collision with the first ball in the aperture. Then, means are provided for displacing balls from the aperture, and causing them to roll on the play field in a direction other than the first direction.

As the result of this, a first ball may roll into the aperture, providing an optional score. Thereafter, until the first ball is removed, other balls which roll to the aperture are deflected, preferably in another predetermined direction by means of a guide chute or the like, so that the second ball goes into another area of the field of play. Then, at some predetermined time, which may be determined by either a timer or by the play that takes place on the play field, a ball displacement apparatus pops the first ball out of the aperture, causing it to roll in another direction from the second ball, for a different mode of play action. Thus, this simple device causes pinballs to act in two very different ways during the play action.

Preferably, an upper ball chute is provided on the play field, with the upper ball chute defining a drop aperture through which a ball rolling in the upper chute can drop. The ball may be placed into the upper chute by any desired way either by jumping from a ramp to the chute, or by any other technique as may be desired.

Also, a lower ball chute can be provided to receive the balls dropping through the above-described drop aperture. The lower ball chute preferably defines the ball-receiving aperture.

Furthermore, the drop aperture may be occluded by a downwardly pivotable, upwardly-biased flap. Balls, rolling in the upper ball chute may roll to the drop aperture and onto the upwardly-biased flap, which rests in its upwardly-biased position in the mouth of the drop aperture in a manner permitting the ball to roll onto it. Then, the weight of the ball causes the pivotable flap to pivot downwardly, permitting the ball to drop through the drop aperture. At the same time, the upwardly biasing force exerted by the pivotable flap provides the ball with transverse rolling motion as it falls through the drop aperture, rolling down the angled flap. Preferably, this transverse rolling motion imparted to the ball causes it to move in the lower chute toward the ball receiving aperture, to be received thereby.

Then, when the ball rests in the ball receiving aperture, a second ball falling through the drop aperture rolls in similar manner toward the ball-receiving aperture, but strikes the ball present therein, rebounds, and then rolls, typically aided by a slight incline in the lower ball chute, in the direction away from the ball receiving aperture to another area of the play field for further game action.

Subsequently, the ball in the aperture may be "popped out" by the ball displacing means, typically being transversely pushed in the process to roll in a direction other than the direction that the second ball takes, typically in the opposite direction of the lower chute, to a destination where the first ball also enters into-play again on the play field.

DESCRIPTION OF DRAWINGS

In the drawings, FIG. 1 is a fragmentary, perspective view of a pinball machine made in accordance with this invention;

FIG. 2 is a fragmentary, perspective view of a portion of the play field of the pinball machine of FIG. 1, showing portions of the upper and lower ball chutes;

DESCRIPTION OF SPECIFIC EMBODIMENT

Figure 3:
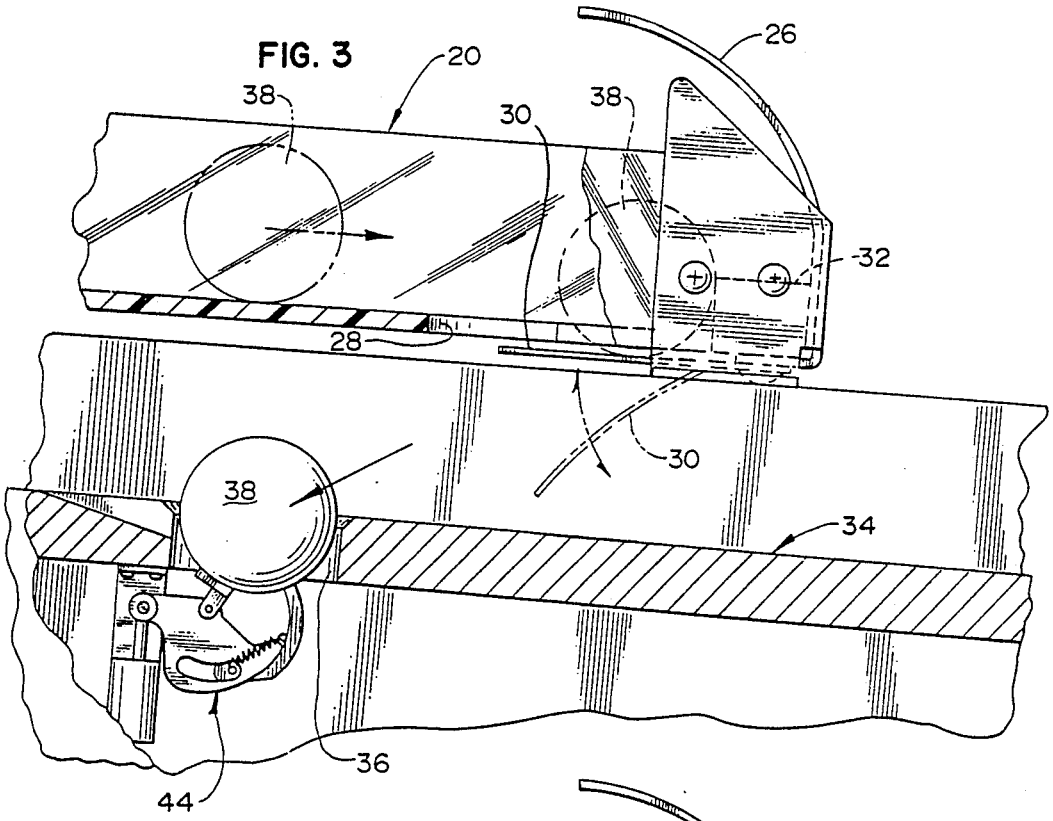
FIG. 3 is a fragmentary, elevational view, taken partly in section, of the structure of FIG. 2 showing the ball-receiving aperture carrying a ball.

Referring to the drawings, FIG. 1 shows a pinball machine 10 which may be of conventional design except as otherwise described herein.

Pinball machine 10 defines a frame 12 that carries play field 14, which typically carries a large number of targets and other conventional pinball machine features, which are not shown herein as they are unnecessary to a complete disclosure of the particular invention of this application. Ball launcher 16 is provided, to launch the ball along chute 18. If desired, chute 18 may be separated from upper ball chute 20 by a gap 19 across which pinballs may jump. If they fail to make the jump to ball chute 20, they then fall down to the rest of the play field 14. Otherwise, other arrangements may be provided in which the pinball rolls on the play field 14, and in one way or another finds its way to upper ball chute 20 as one of the optional targets or achievements of the game.

As is conventional, vertical display 22 may be provided for displaying the score and for otherwise providing attraction to the game.

Referring to FIG. 2, the end portion of upper ball chute 20 is shown, being opposed to the ball entrance 24 of chute 20. As the ball rolls toward the end portion, which carries a stop member 26 so that the ball will not bounce out, it rolls onto drop aperture 28, in which there resides an upwardly biased flexible plastic flap 30 which is attached to end 26 by foam block 32 or the like. The weight of the ball is sufficient to depress flap 30 downwardly, causing the ball to fall through drop aperture 28 to lower ball chute 34. At the same time, the upward biasing force and canted angle of flap 30 is sufficient to provide the ball with a rolling velocity to the left as shown in FIG. 2, as flap 30 snaps upwardly again, so that the ball rolls toward and into ball-receiving aperture 36.

FIG. 3 particularly illustrates this action. Ball 38 is shown to be rolling toward drop aperture 28 in a first phantom figure, bouncing off of stop block 32, which is typically made of foam, to bounce back slightly and then to depress flap 30 by its weight as it falls through drop aperture 28. Because of the angled pivoting action of flap 30, ball 38 is urged to roll to the left in lower chute 34, where it encounters and drops into ball-receiving aperture 36. Flap 30 snaps back to its normal, horizontal position when it ceases to engage a ball.

Figure 4:
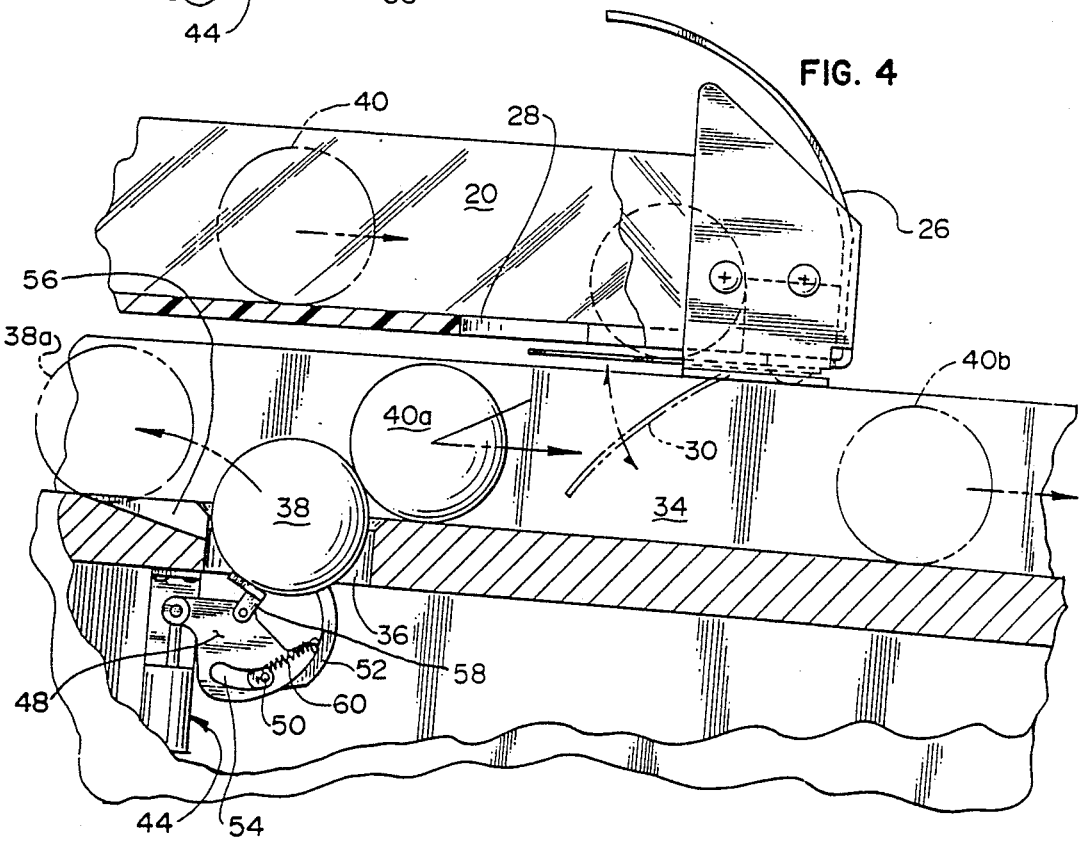
FIG. 4 is a fragmentary, elevational view similar to that of FIG. 3 showing further ball action provided by the structure.

As shown in FIG. 4, while ball 38 resides in aperture 36, a second ball 40 is shown to be rolling in upper ball chute 20 toward drop aperture 28. This second ball 40 drops through drop aperture 20 into lower ball chute 34, in a manner similar to the first ball 38, being forced to roll towards the left by the action of upwardly-biased flap 30. The ball 40*a* is in the position of the second ball when it encounters the first ball at the leftward limit of its rolling. Thereafter, being prevented from further leftward rolling, ball 40 rebounds from the position shown as 40*a*, rolling along lower ball chute 34 in the manner shown by ball 40*b*, outwardly toward another part of the play field, where the ball continues its play. Chute 34 may be slightly sloped to urge balls on the right of aperture 36 to roll away from aperture 36 toward the right.

Ball displacement device 44 may be activated in any desired manner, by a timer or by the happening of some event or events on the play field, to displace ball 38 out of ball-receiving aperture 36 to roll to the left along chute 34 as shown by ball 38*a*. Ball displacement device 44 defines a solenoid 46 which retracts when activated to cause eccentric arm 48 to pivot about pivot 50 in counterclockwise manner. Thus, curved arm 52 rotates counterclockwise as eccentric arm 48 rotates, and slides in slot 54, to throw ball 38 out of ball-receiving aperture 36 up ramp 56, which connects between chutes 34 and aperture 36, to cause ball 38 to roll to the left along chute 34 into another portion of the play field, for continued and different play from the particular play encountered by ball 40.

Platform 58 is also provided on rotating arm 48 to help support ball 38 while it resides in ball-receiving aperture 36.

As solenoid 46 is deenergized, spring 60, which is connected to curved arm 52 from pivot point 50, causes eccentric arm 48 to retract back to the position shown in FIG. 4.

Thus, a new pinball system is provided in which exciting pinball action can take place, with sequential pinballs being directed in opposite directions from each other for greater variety in pinball play. Scoring may of course take place when pinball 38 falls into aperture 36, or when it is popped out of the aperture by apparatus 44. Thus, the invention of this application provides a significant improvement to the excitement of the action of a pinball game.

The above has been offered for illustrative purposes only, and is not intended to limit the scope of the invention of this application, which is as defined in the claims below.

That which is claimed is:

1. In a pinball machine which defines a play field to receive a rolling ball for pinball play, the improvement comprising, in combination:

a ball-retaining aperture defined in said play field, means to provide a plurality of balls simultaneously on said play field, and chute means for directing rolling balls to said ball-retaining aperture, whereby, when said aperture carries a first ball, a second ball rolling in the chute means towards said aperture is prevented from entering said aperture and is deflected by collision with the first ball away from said aperture in a first direction, and means for displacing balls from said aperture and causing them to roll on the play field in a direction other than said first direction.

2. The pinball machine of claim 1 in which said chute means includes a lower ball chute for guiding balls into said ball-retaining aperture, said lower ball chute being sloped to urge said balls to roll in said first direction.

3. In a pinball machine which defines a play field to receive a rolling ball for pinball play, the improvement comprising, in combination:

a ball-receiving aperture defined in said play field, an upper ball chute provide on and above the play field, said upper ball chute defining a drop aperture through which a ball rolling the upper chute can drop onto said playing surface; and a lower ball chute on said play field to receive balls dropping onto said play field and through said drop aperture, said lower ball chute guiding balls into said ball-receiving aperture in said play field, said drop aperture being occluded by a pivotable, upwardly-biased flap, whereby balls falling through said drop aperture are caused to have rolling motion by said flap into and along said lower chute to roll into said ball receiving aperture.

4. The pinball machine of claim 3 in which said lower ball chute is sloped to urge said balls to roll in a direction away from said ball-receiving aperture.

5. A pinball machine which defines a play field to receive a plurality of rolling balls for simultaneous play and a ball launching apparatus for projecting the balls onto the play field, said play field having a ball chute for directing rolling balls toward and into a ball-retaining aperture, and means for displacing balls from the aperture and causing them to roll on the play field in a given direction, the play field being sloped in the vicinity of said ball-retaining aperture in a direction other than said given direction whereby, when said aperture carries a first ball, a second ball rolling in the chute toward the aperture is prevented from entering the aperture and is deflected away from said aperture to roll down the slope in said direction other than said given direction.

6. The pinball machine of claim 5 in which an upper ball chute is supported on said play field in a manner to permit balls rolling on a predetermined portion of said play field to enter said upper ball chute, said upper ball chute defining a drop aperture through which a ball rolling in the upper chute can drop; and a lower ball chute to receive balls dropping through said drop aperture, said lower ball chute defining said ball-receiving aperture.

7. A pinball machine which defines a play field to receive a plurality of rolling balls for simultaneous play and a ball launching apparatus for rolling the balls on the play field, said play field having a first ball chute for directing rolling balls into a ball-retaining aperture in said play field, and means for displacing balls from the aperture and causing them to roll on the play field in a predetermined direction, the play field being sloped in the vicinity of the ball-retaining aperture in a direction other than said predetermined direction whereby, when said aperture carries a first ball, a second ball rolling in the ball chute and attempting to enter said aperture is prevented from entering the aperture by said first ball and is deflected away from said aperture to roll down the slope in said direction other than said predetermined direction; a second ball chute comprising an upper ball chute supported on said play field above said first ball chute said second ball chute having a drop aperture through which a ball rolling in said second ball chute can drop to said first ball chute; said drop aperture being occluded by a pivotable, upwardly biased flap, whereby balls falling through said drop aperture are provided with rolling motion by said flap to roll in said first chute towards said ball receiving aperture.

* * * * *